US011450995B2

(12) United States Patent
Stagner

(10) Patent No.: US 11,450,995 B2
(45) Date of Patent: Sep. 20, 2022

(54) RELEASABLE POWER ASSEMBLY

(71) Applicant: Edward Stagner, Orange, CA (US)

(72) Inventor: Edward Stagner, Orange, CA (US)

( * ) Notice: Subject to any disclaimer, the term of this patent is extended or adjusted under 35 U.S.C. 154(b) by 196 days.

(21) Appl. No.: 16/660,892

(22) Filed: Oct. 23, 2019

(65) Prior Publication Data

US 2021/0126407 A1 Apr. 29, 2021

(51) Int. Cl.
*H01R 13/713* (2006.01)
*H01R 13/627* (2006.01)
*B65D 88/74* (2006.01)

(52) U.S. Cl.
CPC ..... *H01R 13/7132* (2013.01); *B65D 88/74* (2013.01); *H01R 13/6277* (2013.01)

(58) Field of Classification Search
CPC ..... H01R 13/6397; H01R 13/6392; H01R 13/7132; H01R 13/6277; H01R 33/97; B65D 88/74
USPC ..... 439/304
See application file for complete search history.

(56) References Cited

U.S. PATENT DOCUMENTS 1,989,823 A * 2/1935 Raabe ..... H01R 13/447 439/370
2,753,536 A * 7/1956 Tjader ..... H01R 13/6392 439/369
4,029,380 A * 6/1977 Yonkers ..... H02G 15/06 439/95
4,184,732 A * 1/1980 Hudson ..... H01R 13/6392 439/369
4,440,465 A * 4/1984 Elliott ..... H01R 13/6392 24/326
4,875,874 A * 10/1989 Windsor, Jr. ..... H01R 13/6392 439/369
5,179,044 A * 1/1993 Muromachi ..... H01R 13/6392 439/368
5,306,176 A * 4/1994 Coffey ..... H01R 13/6392 439/367
5,336,106 A * 8/1994 Osten ..... H01R 13/6392 439/369
5,393,243 A * 2/1995 Carmo ..... H01R 13/6392 439/369
5,443,397 A * 8/1995 Carl ..... H01R 13/6392 439/369
5,549,482 A * 8/1996 Langlais ..... H01R 13/6392 439/369
5,582,524 A * 12/1996 Sanner ..... H01R 13/6392 29/869
5,785,547 A * 7/1998 Cross ..... H01R 13/6392 439/369

(Continued)

*Primary Examiner* — Harshad C Patel
(74) *Attorney, Agent, or Firm* — Law Office of Glenn Smith; Glenn R. Smith; Lisa L. Smith

(57) ABSTRACT

A releasable power assembly prevents damage to plugs and receptacles connected to refrigerated shipping containers (reefers). Reefers are temporarily stored in shipping port reefer scaffolds and then loaded onto or unloaded off of ground transportation or freighters. However, errors in port command and control systems may result in the failure to unplug reefers prior to loading or unloading. Conventional reefer power plugs and receptacles are twist-locked together and damaged or destroyed if not manually disconnected prior to reefer movement. An advantageous releasable power assembly automatically unlatches before reaching a breaking point for failure to disconnect plug and receptacle.

7 Claims, 11 Drawing Sheets

(56) References Cited

U.S. PATENT DOCUMENTS

| | | | | | |
|---|---|---|---|---|---|
| 5,913,693 | A * | 6/1999 | Fetterolf | H01R 13/6392 | 24/459 |
| 5,931,702 | A * | 8/1999 | Fladung | H01R 31/02 | 439/652 |
| 6,033,251 | A * | 3/2000 | Cook | H01R 13/5812 | 439/369 |
| 6,080,004 | A * | 6/2000 | Kovacik | H01R 13/6392 | 439/352 |
| 6,176,729 | B1 * | 1/2001 | Myers | H01R 13/6392 | 439/369 |
| 6,319,044 | B1 * | 11/2001 | Stekelenburg | H01R 13/6392 | 439/369 |
| 6,802,725 | B2 * | 10/2004 | Rowland | H01R 13/5213 | 439/144 |
| 7,182,624 | B1 * | 2/2007 | Miller | H01R 13/6392 | 439/369 |
| 7,938,671 | B2 * | 5/2011 | Hayden, Sr. | H01R 13/5833 | 439/371 |
| 7,976,331 | B1 * | 7/2011 | Yang | H01R 13/6392 | 439/369 |
| 9,276,359 | B2 * | 3/2016 | Brown | H01R 13/6392 | |
| 10,135,190 | B2 * | 11/2018 | Bozikis | H01R 13/6392 | |
| 10,340,636 | B1 * | 7/2019 | Twenge | A44B 11/28 | |
| 2017/0170603 | A1 * | 6/2017 | Bozikis | H01R 43/26 | |

* cited by examiner

RELEASABLE POWER ASSEMBLY

BACKGROUND OF THE INVENTION

Refrigerated shipping containers or "reefers" are used for freight transport of temperature-sensitive cargo. Freighters routinely transport reefers to and from foreign and domestic ports. Reefers unloaded from freighters at ports where automation is used are typically stored on reefer scaffolds while awaiting ground transportation or shipping. Reefer scaffolds are equipped with 440-volt, three-phase AC power receptacles. Power plugs and corresponding plug power cords connect between scaffolding power receptacles and reefers so as to maintain refrigerated temperatures until the reefers are loaded onto or unloaded off of shipping or ground transportation to their ultimate destination.

SUMMARY OF THE INVENTION

Reefer power plugs are twist-locked into 440-volt power receptacles located on reefer scaffolding. All too often, personnel or computer errors erroneously indicate that a reefer is unplugged and ready to load onto or off of a ship or ground transportation. Loading or unloading plugged-in reefers risks damage or destruction to reefer power plugs, power receptacles and power cords. Such damage or destruction also results in danger to personnel from live wires on wet or metal decks, reefer scaffold down time, repair costs and shipping delays. An advantageous releasable power plug is configured to automatically unlatch from a power receptacle before a power plug and/or a plug power cord are strained to the breaking point.

One aspect of a releasable power assembly is a power plug having conductive plug terminals and a power receptacle having conductive receptacle terminals. The conductive plug terminals removably insert into the conductive receptacle terminals, a plug power cord extends from the plug and a receptacle power cord extends from the receptacle. Further, a pair of ring latches are disposed on the receptacle. The ring latches have a locked position that secures the power plug to the power receptacle and the ring latches having an unlocked position that releases the power plug from the power receptacle.

In various embodiments, the releasable power assembly has a loop trigger fixedly attached to a first one of the ring latches and is removably attached to second one of the ring latches. The loop trigger unlocks the ring latches from the receptacle when the loop trigger is removed from the second one of the ring latches. The plug power cord is looped around the loop trigger so as to remove the loop trigger from the second one of the ring latches when a pulling force is applied to the plug power cord. The ring latches of the releasable power assembly have a pair of footings that extend from the ring latches and are disposed against plug collar in the locked position. Each of the ring latches have a handle, a tension frame rotatably attached to the handle and a threaded T-bolt partially disposed within, and protruding from the tension frame.

In various other embodiments, a strap T-clamp and a cap T-clamp are fixedly disposed on opposite sides of the receptacle and the ring latches are rotatably disposed through the strap T-clamp and the cap T-clamp on opposite ends of the strap T-clamp and the cap T-clamp. A safety cap assembly has a safety cap, a lever and a hinge, which is fixedly attached to the cap T-clamp. The lever has a first end rotatably disposed within the hinge and a second end fixedly attached to the safety cap. The safety cap has an open position disposed adjacent the plug when the plug is disposed within the receptacle and the safety cap has a closed position disposed over the receptacle when the plug is removed from the receptacle. The releasable power assembly further has a safety strap attached to the strap T-clamp so as to secure the power receptacle to a safety railing of the reefer rack scaffolding.

Another aspect of releasable power assembly is a releasable power method of clamping a power plug to a power receptacle, exerting a pulling force on a plug power cord in electrical communications with the power plug and releasing the power plug from the power receptacle in response to the pulling force so as to avoid damage to the conductive power cord. In various embodiments, clamping comprises locking a pair of ring latches that extend from the power receptacle against a power plug collar, and releasing the power plug from the power receptacle comprises looping the plug power cord around a loop trigger and removing the loop trigger from one of the ring latches in response to the pulling force. Also, removing the loop trigger comprises rotating the ring latches away from the power plug and rotating the ring latches away from the power plug comprises spring-loading the ring latches.

In various other embodiments, the releasable power method comprises disconnecting the power plug from the power receptacle, clamping a strap T-clamp and a cap T-clamp on opposite sides of the power receptacle and securing a cap assembly to the cap T-clamp. Also, the releasable power method comprises rotating the cap assembly from a first position distal power receptacle terminals to a second position proximate power receptacle terminals, securing a first end of a strap on the strap T-clamp and securing a second end of the strap on a reefer rack scaffold railing.

A releasable power assembly has been disclosed in detail in connection with various embodiments. These embodiments are disclosed by way of examples only and are not to limit the scope of the claims that follow. One of ordinary skill in art will appreciate many variations and modifications.

DETAILED DESCRIPTION OF THE PREFERRED EMBODIMENTS

Figure 1:
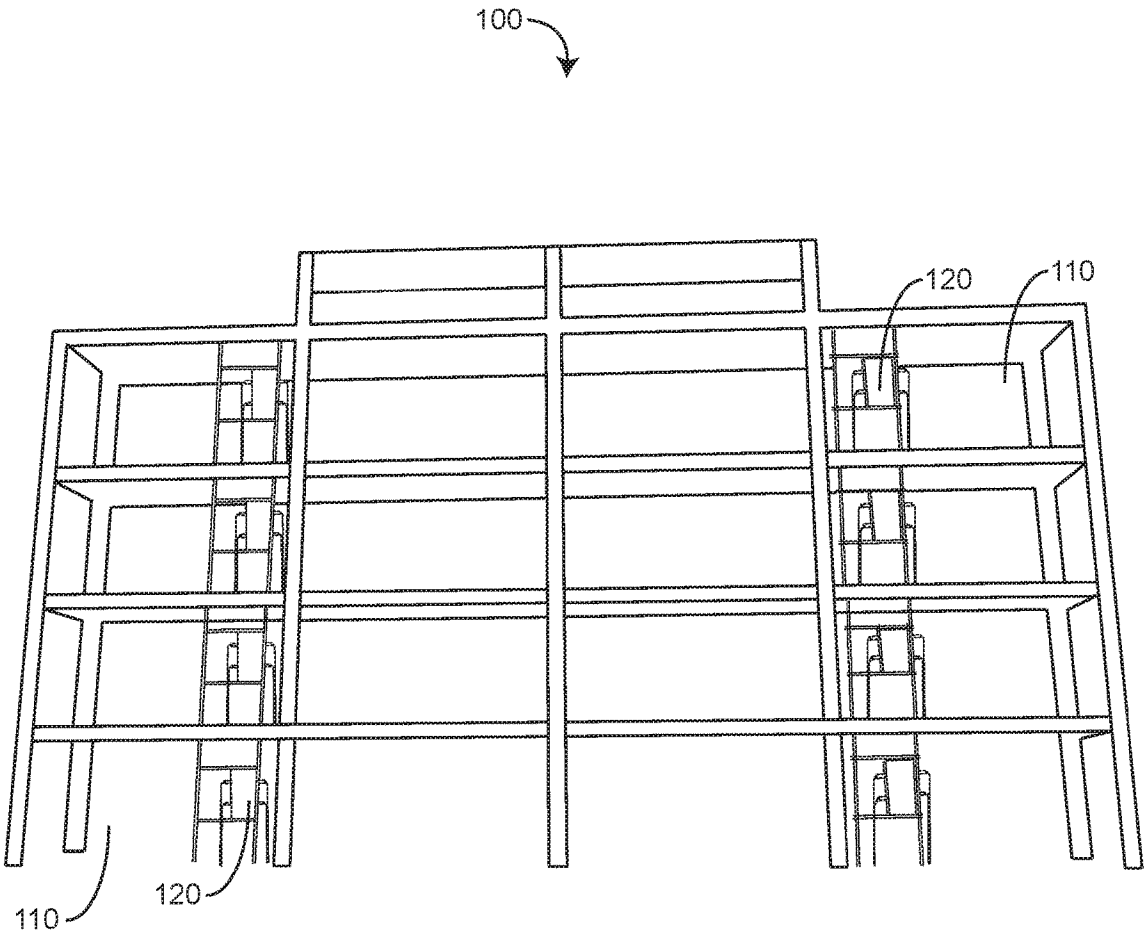
FIG. 1 (Prior Art)
FIG. 1 is a perspective view of a prior art reefer block scaffold.
Figure 2:
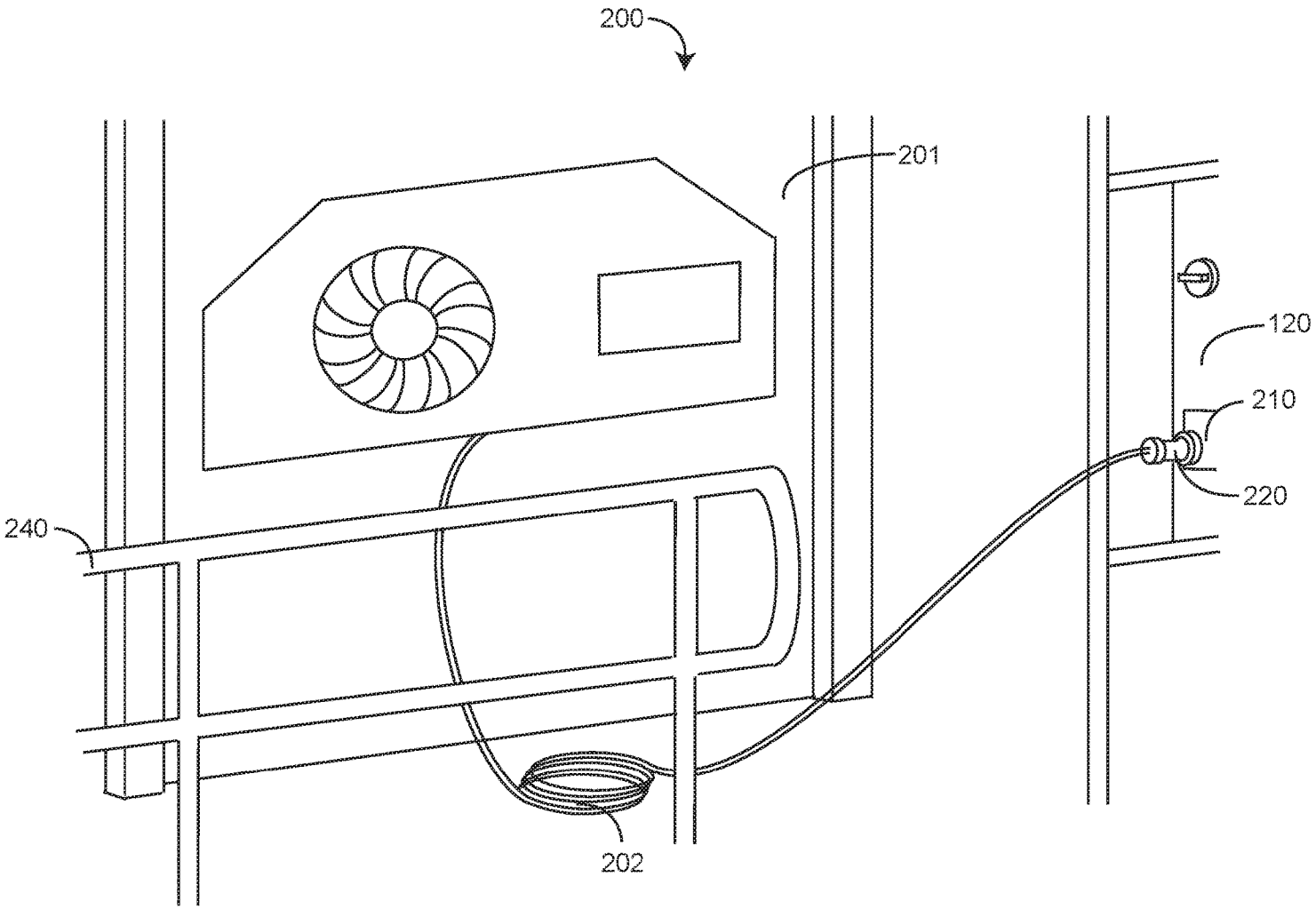
FIG. 2 (Prior Art)
FIG. 2 is close-up perspective view of a prior art refrigerated seagoing container (reefer) plugged into reefer scaffolding power with a prior art 440 volt plug.
Figure 3:
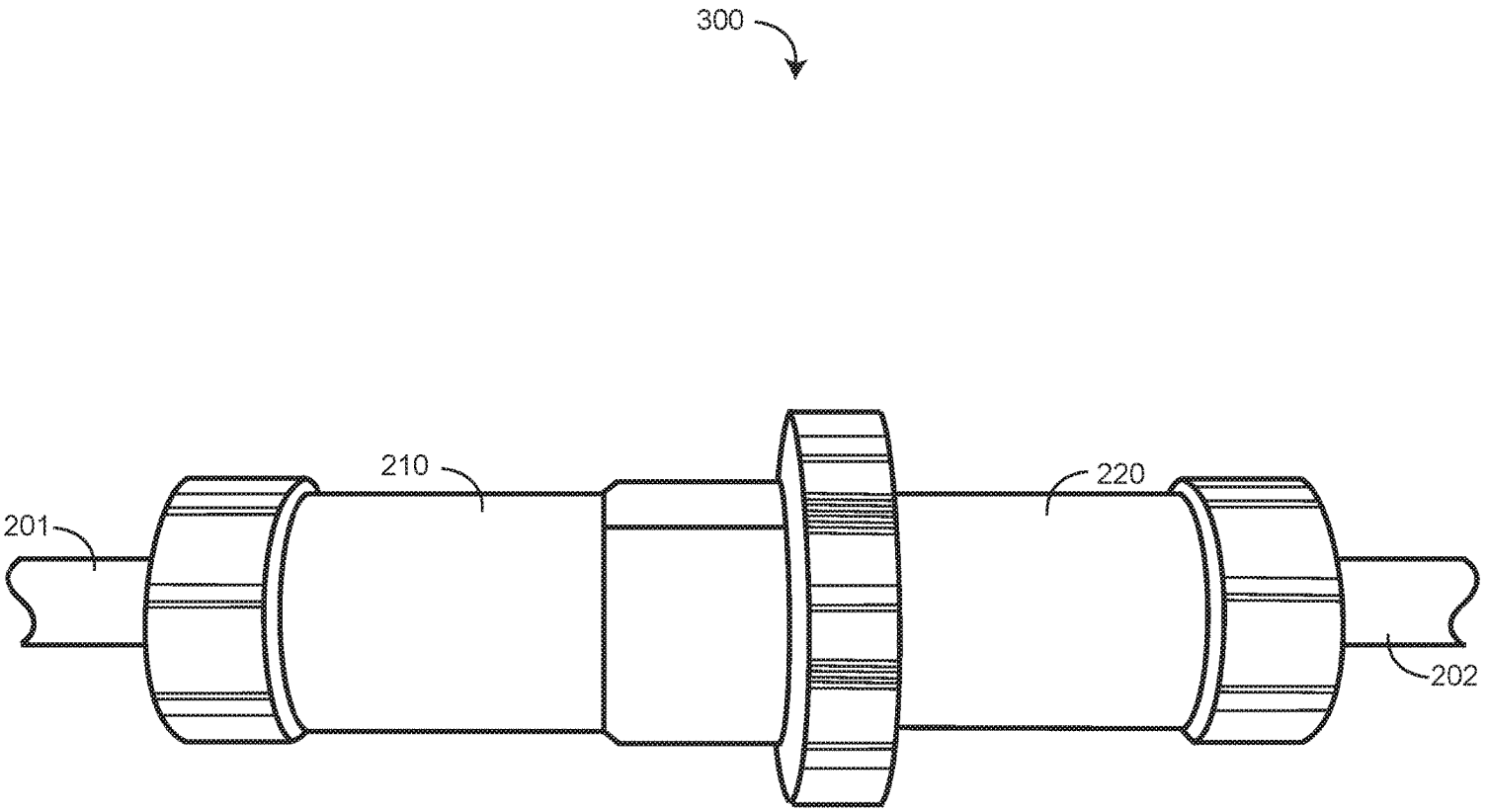
FIG. 3 (Prior Art)
FIG. 3 is a close-up perspective view of a prior art power plug twist-locked into a prior art power receptacle.

FIG. 1 illustrates an empty reefer block scaffold 100 having a plurality of reefer scaffold compartments 110 and power boxes 120. FIG. 2 illustrates a reefer scaffold portion 200 and a corresponding reefer 201 (refrigerated container) located behind a reefer rail 240. The reefer 201 is connected to scaffold power 120. In particular, a reefer power cord 202 terminates at a 440-volt power plug 220 that twist-locks into a power receptacle 210 connected to shore power. FIG. 3 illustrates a prior-art 440-volt power plug 220 twist-locked into a prior art 440-volt power receptacle 210. A receptacle power cable 201 provides 440-volt input power, and a plug power cable 202 provides 440-volt output power.

Figure 4:
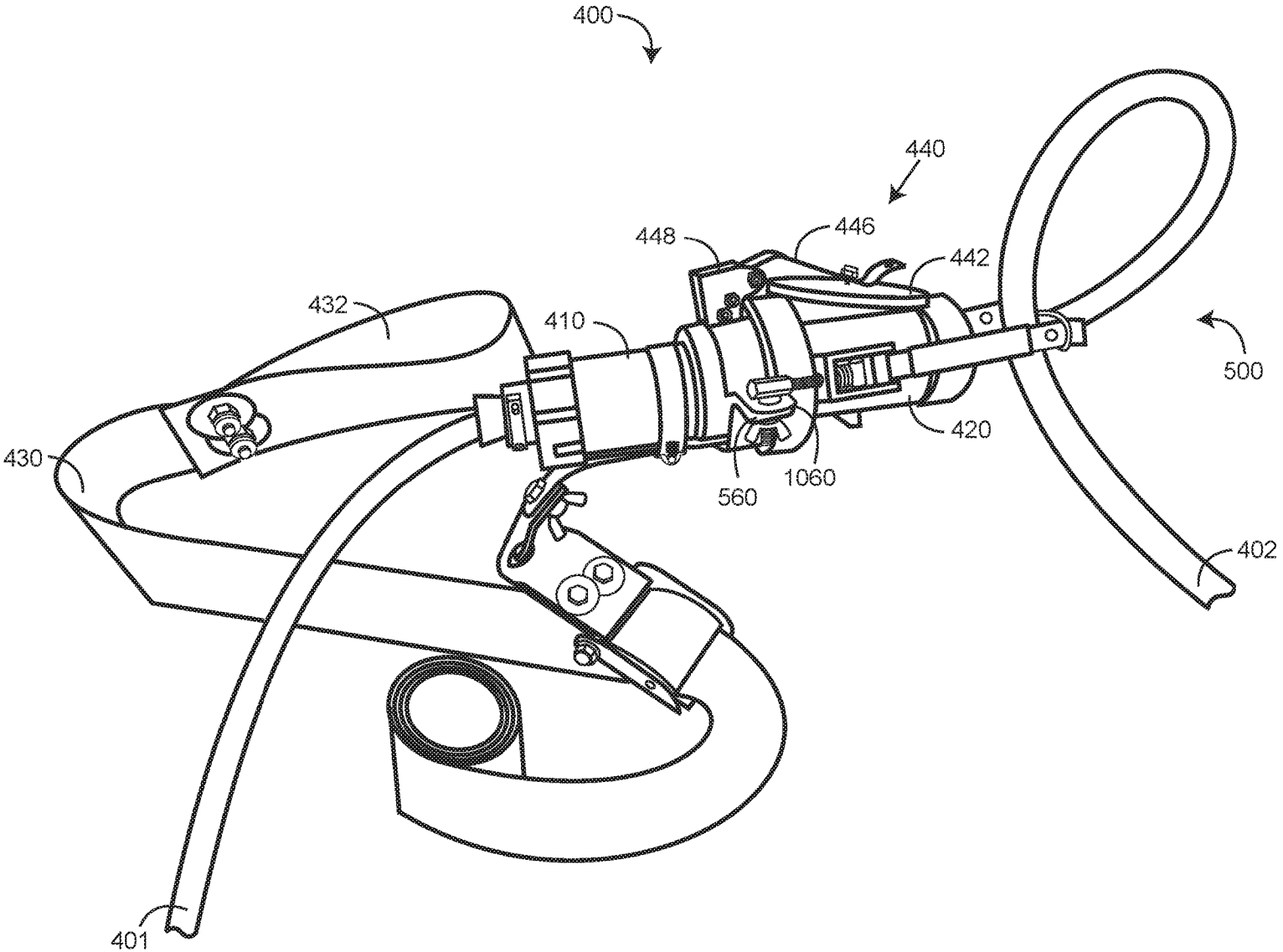
FIG. 4 is perspective view of an advantageous releasable power assembly having a plug and a receptacle.

FIG. 4 illustrates an advantageous releasable power assembly 400 having a looped power-cord trigger 500. Specifically, a power plug 420 releases from a connected power receptacle 410 when excessive tension is exerted on the plug power cord 402. In one configuration, the power receptacle 410 is connected to a safety strap 430 having 2-inch webbing and a handrail loop 432. The handrail loop 432 is secured to a reefer scaffold rail 240 (FIG. 2) so as to prevent excessive tension from being exerted on the power receptacle 410 or the receptacle cord 401. In addition, the high-voltage power receptacle 410 has a spring-loaded safety cap 442 that covers the power receptacle terminals 810 (FIG. 8) when the power plug 420 is removed from the power receptacle.

As shown in FIG. 4, a safety cap assembly 440 is secured to a cap T-clamp 1060. The safety cap assembly 440 has a hinge 448, a lever 446 and a safety cap 442. The lever 446 extends from the hinge 448 and is bolted to the safety cap 442. As described below, the cap T-clamp 1060 mates with an opposite facing strap T-clamp 560 (FIG. 5) so as to secure both T-clamps 560, 1060 to the power receptacle 410. See also FIGS. 8 and 10.

Figure 5:
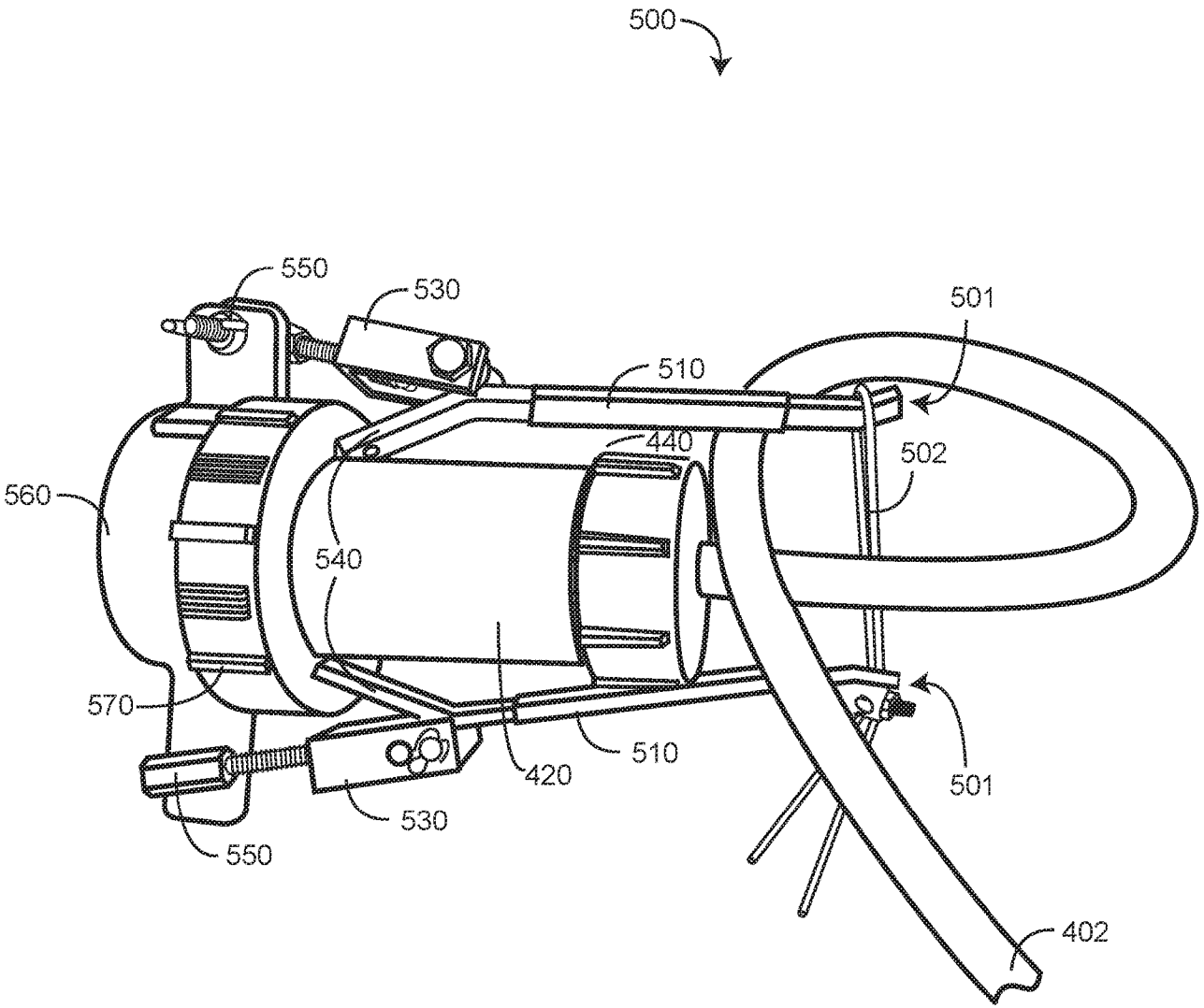
FIG. 5 is a close-up perspective view of the releasable power assembly and its corresponding power cord release triggering mechanism.
Figure 10:
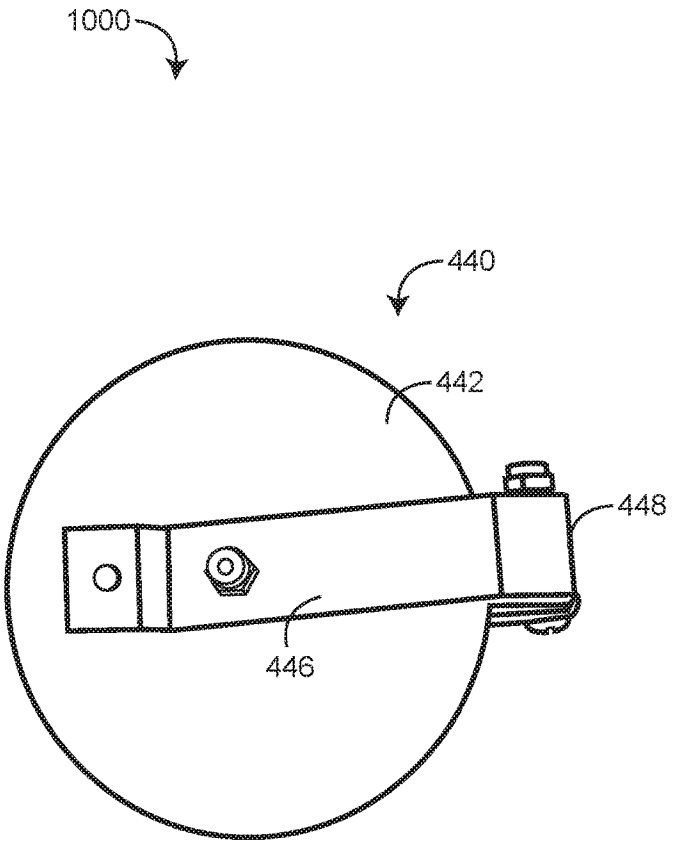
FIG. 10 is a front view of a receptacle cap and mating clamp assembly.

FIG. 5 illustrates in detail an advantageous releasable power assembly 500 that prevents excessive force from being exerted on the plug cord 402, such as when a power plug 420 is not manually unplugged from a power receptacle 410 prior to attempting to load a reefer onto ground transportation. In particular, the reefer power plug 420 has a pair of advantageous ring latches 501 disposed on either side of the plug 420. These ring latches 501 are spring-loaded and held in a locked position by a loop trigger 502. A first end of the loop trigger 502 is fixedly attached to a first one of the ring latches 501 and a second end of the loop trigger 502 forms a loop that is removably attached to a second one of the ring latches 501. The ring latches 501 each have a handle 510, a tension frame 530 and a footing 540. The ring latches are rotatably secured by pivots 550 to the receptacle 410 by a strap T-clamp 560 and an opposite-facing safety-cap T-clamp 1060 (FIG. 10).

As shown in FIG. 5, the footings 540 secure the plug 420 to the receptacle 410 under adjustable pressure from the tension frames 530 on the plug collar 570. If a reefer is removed from the reefer scaffold without first disconnecting it from reefer scaffold power, tension on the plug cord 402 pulls the release cord 502 off of one of the ring latches 501. In turn, the ring latches 501 disengage from the plug collar 570, which advantageously allows the plug 420 to mechanically and electrically disengage from the receptacle 410. As such, inadvertent damage to reefer and reefer scaffold power assemblies are avoided.

Figure 6:
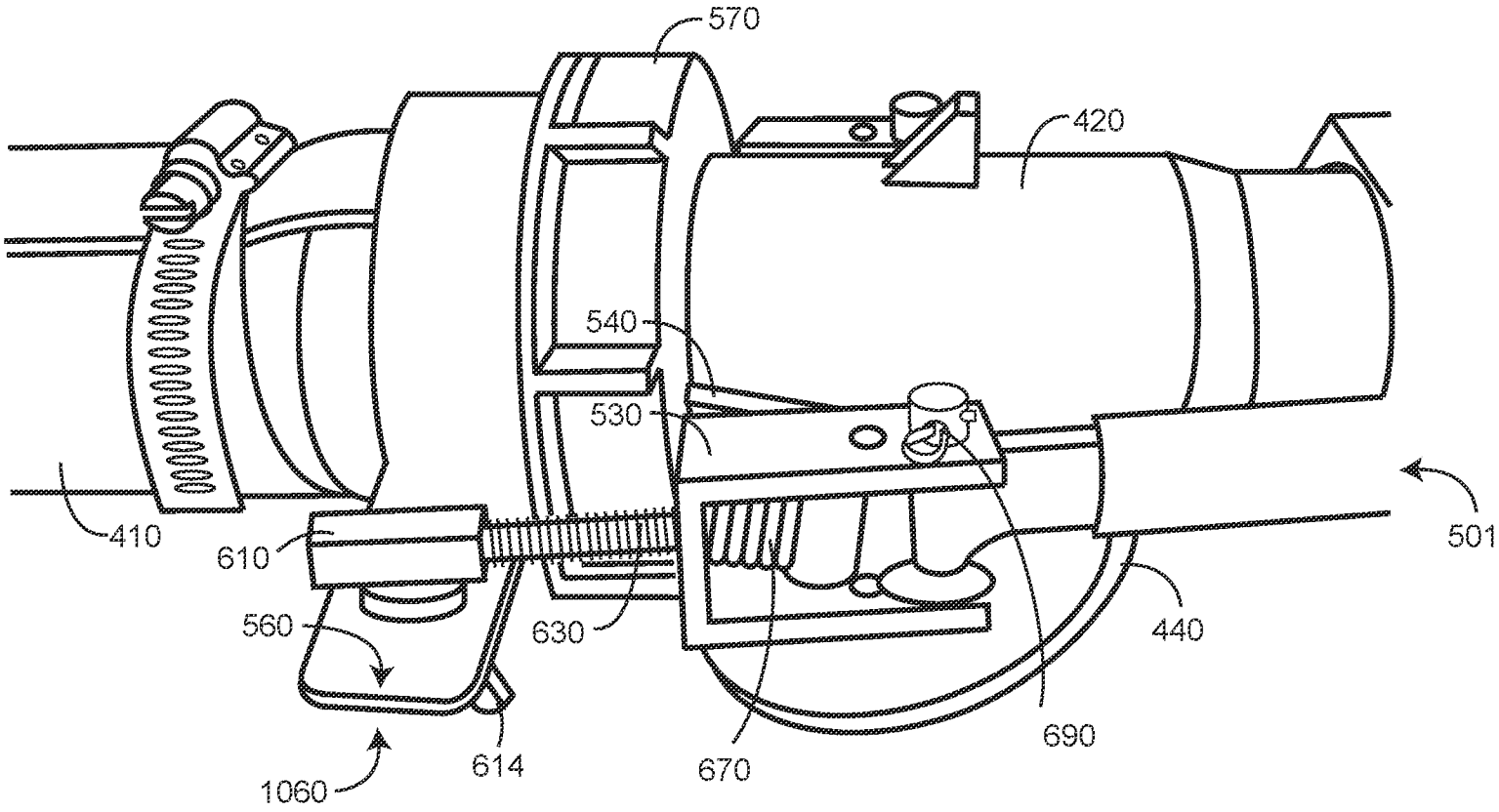
FIG. 6 is a close-up perspective view of a spring-loaded clamp release mechanism.

FIG. 6 further illustrates a receptacle 410, a plug 420 and one of the two ring latches 501 rotatably attached to opposite-facing T-clamps 560 and 1060. A nut assembly 610 receives a threaded T-bolt 630, which extends from a tension frame 530. A clamp spring 670 disposed within the tension frame 530 applies force to the footings 540, so that the footings 540 tend to disengage from the plug collar 570 when the triggering mechanism 502 (FIG. 5) disengages from one of the ring latches 501. The tension frames 530 are rotatably connected to the footings 540 by a pin 690 disposed through both the tension frames 530 and the ring latches 501.

Figure 7:
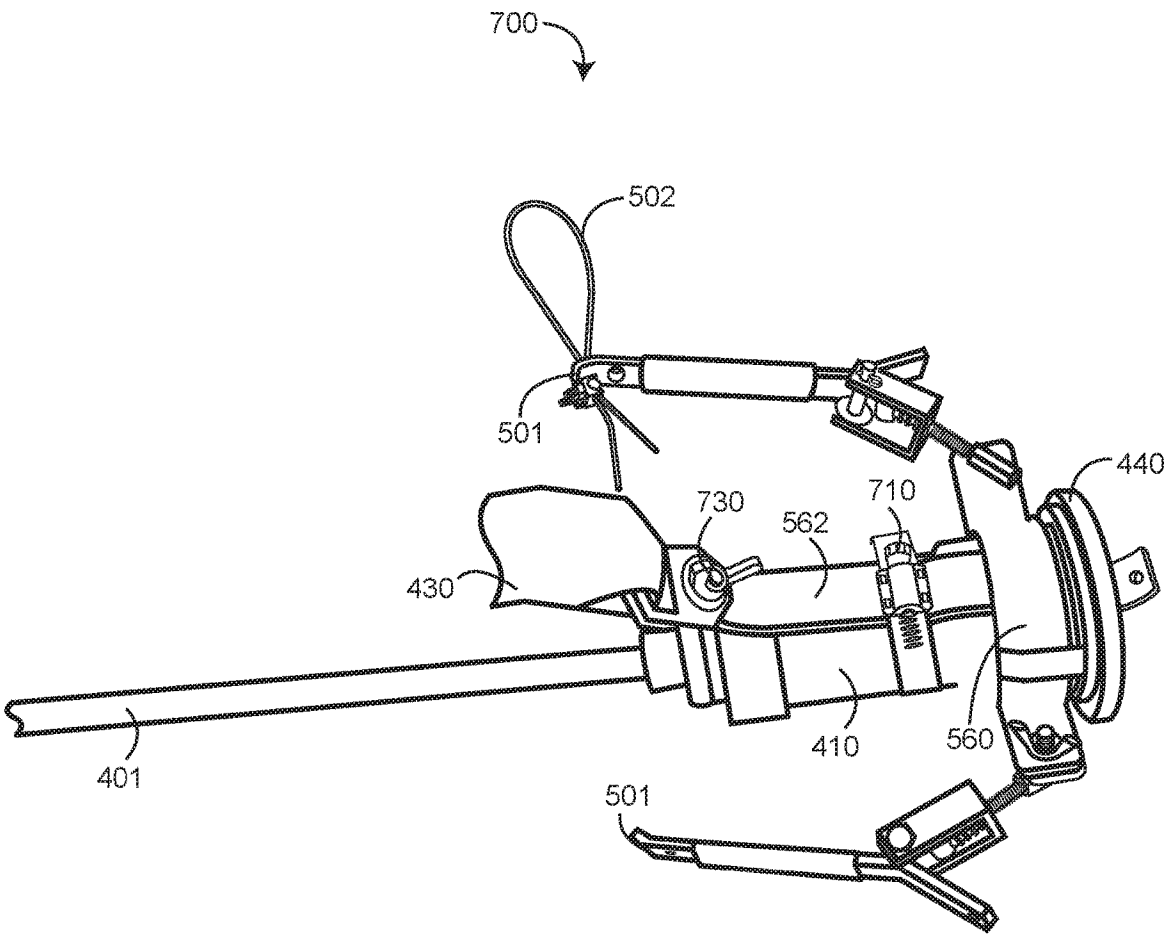
FIG. 7 is a perspective view of an releasable receptacle.
Figure 8:
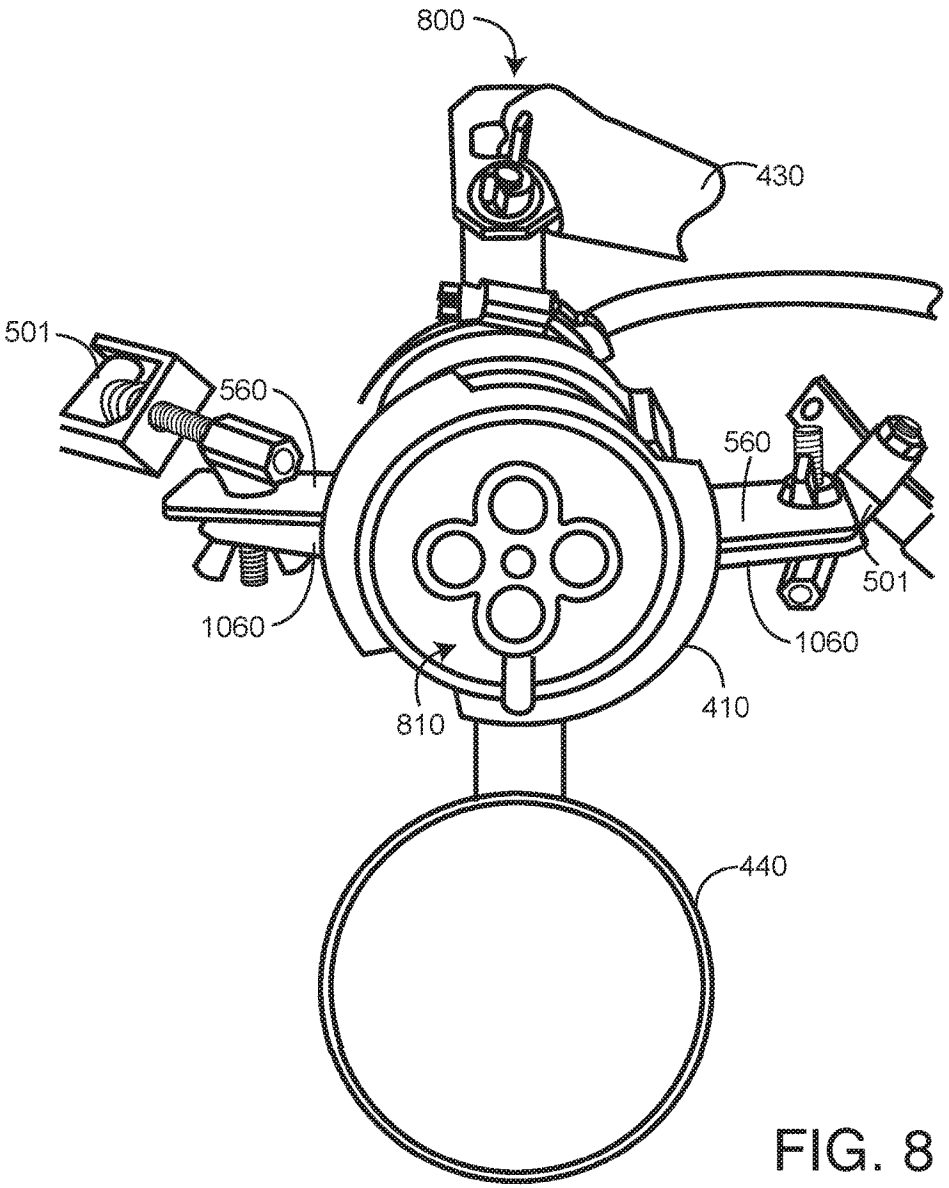
FIG. 8 is a front view of the releasable receptacle assembly.

FIG. 7 illustrates a receptacle assembly 700 after an advantageously-triggered release from a plug 420 (FIG. 6). Such a triggered release prevents a receptacle 410 and/or a plug 420 (FIG. 6) from being damaged during reefer unloading with reefer power inadvertently connected. During a triggered receptacle release, a power cable 402 (FIG. 5) pulls the triggering mechanism 502 from one of the ring latches 501, causing both latches 501 to rotate off of, and away from, the plug collar 570 (FIG. 6). This allows the plug 420 (FIG. 6) to disengage from the receptacle 410 and the spring-loaded receptacle cap 440 to flip over the receptacle so as to cover the receptacle terminals 810 (FIG. 8). A safety strap 430 is secured to a T-clamp 560 via a T-clamp tongue 562 extending from the T-clamp 560. A hose clamp 710 further secures the T-clamp tongue 562 to the receptacle 410. The safety strap 430 is secured to the tongue 562 with a screw and wing-nut 730. This, allows the safety strap 430, and in turn the receptacle assembly 700, to be fixedly secured to a reefer scaffold handrail.

FIG. 8 further illustrates a receptacle assembly 800 with a normally closed safety cap 440 manually held in an open position so as to reveal the socket 410 power terminals 810. The plug 410 is disposed between the strap T-clamp 560 and the cap T-clamp 1060. A pair of ring latches 501 are shown in an unlatched position, which is also depicted in FIG. 7. The ring latch pair 501 are rotatably are disposed through opposite sides of the T-clamps 560, 1060 and held in place with wing nuts.

Figure 9:
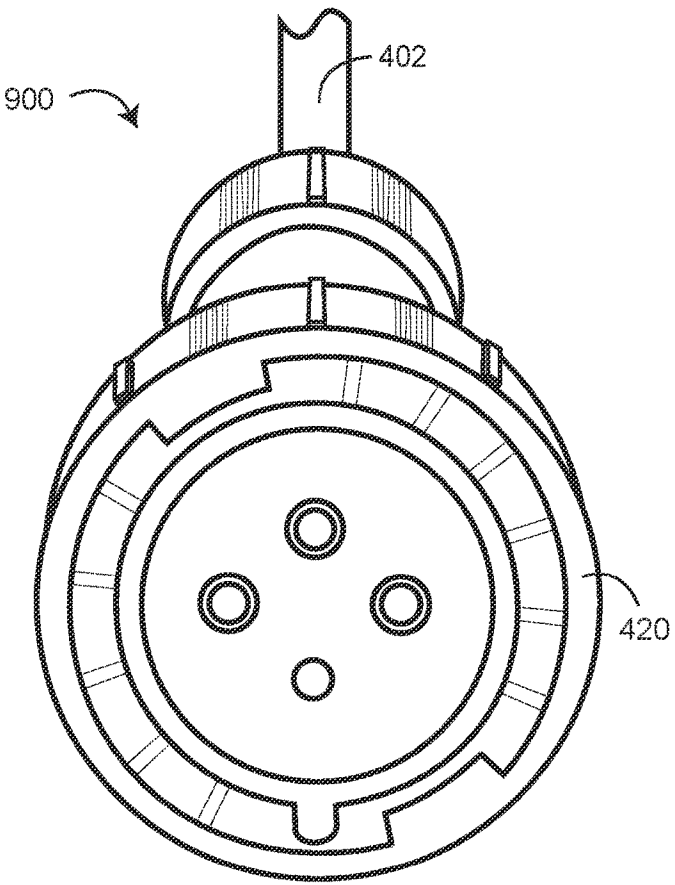
FIG. 9 is a front view of the releasable plug.

FIG. 9 further illustrates a standard, 3-phase, 440-volt plug 900 having a plug collar 420 designed to twist-lock onto a standard receptacle. See FIG. 3. However, used in conjunction with the power receptacle 800 described with respect to FIG. 8, above, the power plug is not twist-locked onto the receptacle, but rather is releasably connected to the receptacle as shown and described with respect to FIGS. 4-7, above.

FIG. 10 illustrates a receptacle cap assembly 1000. As noted with respect to FIG. 4, above, the safety cap 440 has a cap bracket 1060 attached to a spring-loaded hinge 446. A lever 448 extends from the hinge 446 and is bolted to a cap lid 442. The cap bracket 1060 mates with an opposite facing strap bracket 560 (FIG. 5) so as to secure both the cap bracket 444 and the strap bracket 560 to the power receptacle 410.

Figure 11:
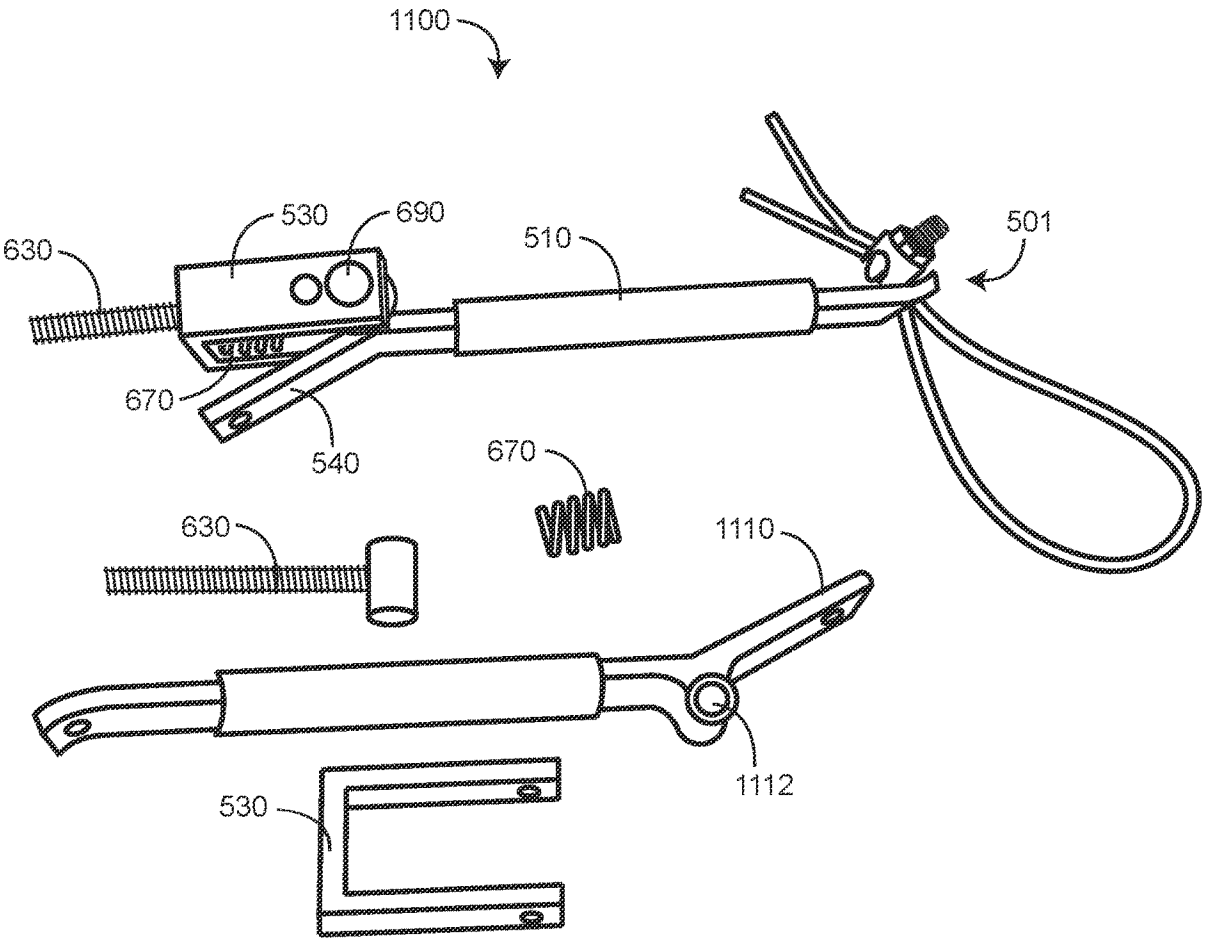
FIG. 11 are assembled and exploded views of the spring-loaded clamp release mechanisms.

FIG. 11 further illustrates one of the two ring latches 501 and its corresponding components 1100. A spring frame 530 is attached to a handle 510 via a pin 690. The ring latch 501 has a threaded T-bolt 630 partially disposed within, and protruding from, the tension frame 530. A spring 670 is disposed within the tension frame 530 and the T-bolt 630 so as to attach to the cap bracket 444 (not shown) and strap bracket 560 (not shown). A handle bar 1110 provides a pin hole 1112 so as to attach the spring frame 530 to the handle bar 1110 via the pin 690.

What is claimed is:

1. A releasable power assembly comprising:

a power plug having a plurality of conductive plug terminals;

a power receptacle having a plurality of conductive receptacle terminals;

the conductive plug terminals removably insert into the conductive receptacle terminals;

the power plug removably locks to the power receptacle;

a plug power cord extends from the plug;

a receptacle power cord extends from the receptacle;

the power plug cord reacts to a pulling force so as to unlock the power plug from the power receptacle; a loop trigger is fixedly attached to a first one of the ring latches and is removably attached to second one of the ring latches; the loop trigger unlocks the ring latches from the receptacle when the loop trigger is removed from the second one of the ring latches; and the plug power cord is looped around the loop trigger so as to remove the loop trigger from the second one of the ring latches when a pulling force is applied to the plug power cord.

2. The releasable power assembly according to claim 1 wherein the ring latches further comprise a pair of footings that extend from the ring latches and are disposed against plug collar in the locked position.

3. The releasable power assembly according to claim 2 wherein each of the ring latches comprise:

a handle;

a tension frame rotatably attached to the handle; and a threaded T-bolt partially disposed within, and protruding from the tension frame.

4. The releasable power assembly according to claim 3 further comprising:

a strap T-clamp and a cap T-clamp fixedly disposed on opposite sides of the receptacle; and the ring latches rotatably disposed through the strap T-clamp and the cap T-clamp on opposite ends of the strap T-clamp and the cap T-clamp.

5. The releasable power assembly according to claim 4 further comprising:

a safety cap assembly having a safety cap, a lever and a hinge;

the hinge is fixedly attached to the cap T-clamp; and the lever has a first end rotatably disposed within the hinge and a second end fixedly attached to the safety cap.

6. The releasable power assembly according to claim 5 further comprising:

the safety cap has an open position disposed adjacent the plug when the plug is disposed within the receptacle; and the safety cap has a closed position disposed over the receptacle when the plug is removed from the receptacle.

7. The releasable power assembly according to claim 6 further comprising a safety strap attached to the strap T-clamp so as to removably secure the power receptacle to a reefer rail.

* * * * *